United States Patent [19]

Kondo et al.

[11] Patent Number: 4,526,524

[45] Date of Patent: Jul. 2, 1985

[54] VANE COMPRESSOR

[75] Inventors: Makoto Kondo; Eiichi Nagasaku, both of Chiryu; Yuuji Yamamoto, Anjo; Tosiki Taya, Kariya, all of Japan

[73] Assignee: Nippondenso Co., Ltd., Kariya, Japan

[21] Appl. No.: 618,353

[22] Filed: Jun. 7, 1984

[30] Foreign Application Priority Data

Jun. 8, 1983 [JP] Japan ..... 58-102247

[51] Int. Cl.[3] ..... F04C 18/00

[52] U.S. Cl. ..... 418/255; 418/259; 418/270

[58] Field of Search ..... 418/255, 259, 266–270, 418/70, 253, 256

[56] References Cited

U.S. PATENT DOCUMENTS

| | | | |
|---|---|---|---|
| 3,011,449 | 12/1961 | Ernst | 418/269 |
| 3,130,673 | 4/1964 | Finstad | 418/268 |
| 3,193,190 | 7/1965 | Lindberg | 418/269 |
| 3,213,803 | 10/1965 | Meyer | 418/255 |
| 3,734,652 | 5/1973 | Barnett | 418/270 |
| 4,397,620 | 8/1983 | Inagaki | 418/259 |

*Primary Examiner*—Leonard E. Smith
*Assistant Examiner*—Jane E. Obee
*Attorney, Agent, or Firm*—Cushman, Darby & Cushman

[57] ABSTRACT

A rotor cover is disposed at one end surface of a rotor which has a ring-shaped locking ridge on the end surface thereof. The locking ridge has an outer peripheral surface fitted in a locking groove in the rotor cover. A holder is held against an inner peripheral surface of the locking ridge. With this arrangement, the diameter of the rotor is kept constant at all times, and so is the gap between the rotor and the housing, thus preventing scuffing of the rotor and the housing.

3 Claims, 5 Drawing Figures

VANE COMPRESSOR

BACKGROUND OF THE INVENTION

The present invention relates to a vane compressor, and more particularly to a vane compressor for use as a refrigerant compressor in an automobile air conditioning system.

Vane compressors have a working chamber defined by the outer periphery of a rotor, side surfaces of vanes, the inner surface of a housing, and the inner surfaces of side plates. As the rotor rotates, the working chamber varies its volume to draw and discharge a refrigerant. Studies conducted by the inventor of conventional vane compressors have indicated that the rotor and the housing are subjected to much scuffing at one end surface of the rotor in operation.

Such scuffing appears to be caused, according to the inventor, for the following reason:

Any pool of liquid refrigerant left in the working chamber is compressed especially when the compressor is started. When this happens, as shown in FIG. 1 of the accompanying drawings, an unduly high pressure is exerted on vanes 1 which cause vane slots 2 to be widened. Since the vane slots 2 are cut out in the rotor 3 from one end surface 3*a* thereof, the vane slots 2 are widened to a larger extent particularly at such rotor end surface 3*a*. Therefore, the rotor 3 is radially outwardly enlarged especially at the end surface 3*a* into pressing engagement with an inner surface 8*a* of the housing 8, with the result that the rotor 3 and the housing 8 are scuffed.

SUMMARY OF THE INVENTION

With the above conventional difficulty in view, it is an object of the present invention to provide a vane compressor designed to prevent a rotor from being radially enlarged to avoid scuffing of the rotor and the housing.

According to the present invention, a rotor cover is disposed at one end surface of a rotor which has a ring-shaped locking ridge on the end surface thereof. The locking ridge has an outer peripheral surface fitted in a locking groove in the rotor cover. A holder is held against an inner peripheral surface of the locking ridge. With this arrangement, when the rotor is subjected to forces tending to spread the rotor radially outwardly, the outer peripheral surface of the locking ridge is pressed against the rotor cover to prevent the rotor from being spread radially outwardly. When forces are applied to the rotor in a direction to contract the rotor radially inwardly, the inner peripheral surface of the locking ridge is pressed against the holder to prevent the rotor from being deformed radially inwardly. The diameter of the rotor is therefore kept constant at all times, and so is the gap between the rotor and the housing, thus preventing scuffing of the rotor and the housing.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 2:
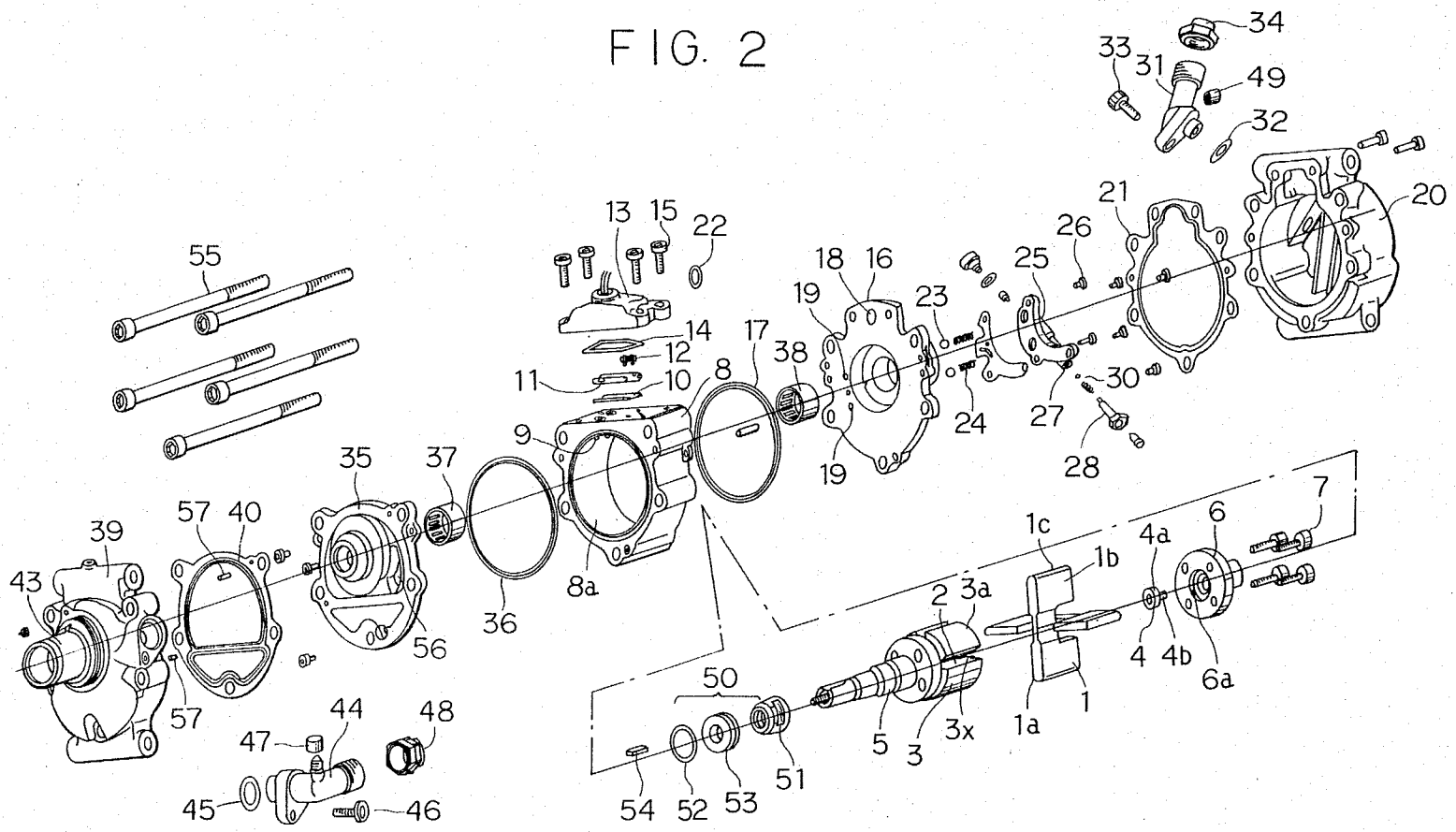
FIG. 2 is an exploded perspective view of a vane compressor according to an embodiment of the present invention.

As shown in FIG. 2, a vane compressor according to the present invention includes a drive shaft 5 having an integral rotor 3. The drive shaft 5 and rotor 3 are made of steel (SCr9) and have a coeffcient of thermal expansion of about $12\times10^{-6}$. The rotor 3 has cross-shaped radial vane slots 2 defined therein and extending from one end surface 3*a* fully across the width of the rotor 3.

Vanes 1, each substantially C-shaped, are slidably disposed in the vane slots 2, and have a central portion 1*a* thinner than vane bodies 1*b* thereof. The vanes 1 are made of an aluminum alloy of high silicon, and have a coefficient of thermal expansion of about $18\times10^{-6}$. The vanes 1 have distal ends 1*c* tapered into slightly thinner edges. The end surface 3*a* of the rotor 3 is covered with a rotor cover 6 fastened thereto by bolts 7 extending through the rotor cover 6 into threaded holes in the rotor 3.

Figure 1:
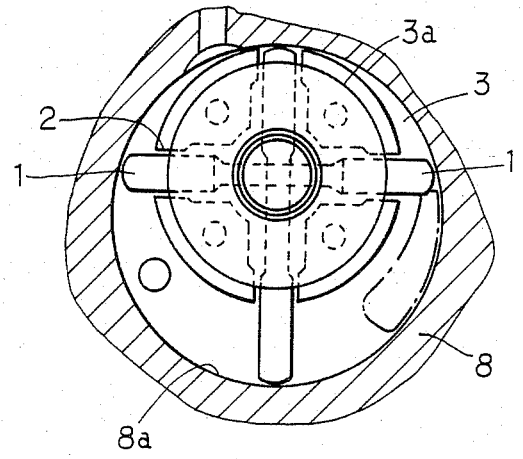
FIG. 1 is a side elevational view, partly in cross section, of a conventional vane compressor.
Figure 3:
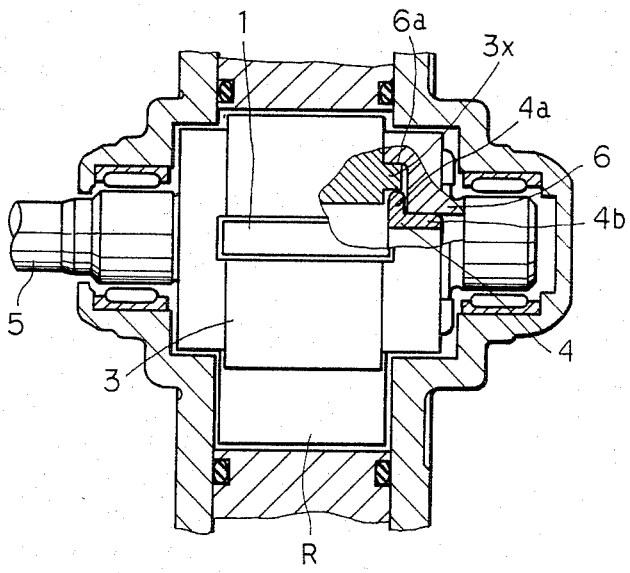
FIG. 3 is an elevational view, partly in cross section, of a rotor assembly in the vane compressor of FIG. 2.

A holder 4 in the form of a stepped cylinder is interposed bewteen the rotor end surface 3*a* and the rotor cover 6. As shown in FIG. 3, the rotor end surface 3*a* has an integral ring-shaped locking ridge 3*x* with its outer peripheral surface engaging in a locking groove 6*a* defined in a side surface of the rotor cover 6 which faces the rotor 3. The holder 4 has a larger-diameter portion 4*a* having an outer peripheral surface pressed against the inner peripheral surface of the locking ridge 3*x*, and a smaller-diameter portion 4*b* pressed against an inner peripheral surface of the rotor cover 6.

The components 1 through 7 referred to above are assembled as follows: The vanes 1 are axially inserted into the cross-shaped vane slots 2, and the holder 4 is press-fitted into the rotor 3 with the larger-diameter portion 4*a* held against the inner peripheral surface of the locking ridge 3*x*. Then, the rotor cover 6 is placed on the rotor end surface 3*a* with the outer edge of the locking groove 6*a* fitting over the outer peripheral surface of the locking ridge 3*x*. The bolts 7 are threaded through the rotor cover 6 into the rotor end surface 3*a*, whereupon a rotor assembly is completed.

The rotor 3 is accommodated in a housing 8 made of an iron-base material (FCD9) which is of the same kind as the material of the rotor 3. The housing 8 has a substantially cylindrical inner surface 8*a*. The inner surface 8*a*, the outer peripheral surface of the rotor 3, and the vanes 1 jointly define a working chamber R. The housing 8 has a discharge port 9 covered with a discharge valve 10 having a cover 11. The discharge valve 10 and the cover 11 are fixed to the housing 8 by screws 12.

The discharge valve 10 is covered with a discharge chamber housing 13 fixed to the housing 8 by bolts 15 with a resilient ring 14 interposed therebetween. A side plate 16 is attached to one end surface of the housing 8 with an O-ring 17 interposed therebetween, the side plate 16 being made of cast iron (FCR9) which is of the same kind as the material of the rotor 3. The side plate 16 has defined therethrough a discharge passage 18 communicating with the discharge chamber 13*a* in the discharge chamber housing 13 and sludge ports 19 opening into the working chamber R. The side plate 16 accommodates a bearing 38 fitted therein and by which the rotor cover 6 is rotatably supported. A sealing O-ring 22 is interposed between the discharge chamber housing 13 and the side plate 16 in surrounding relation to the discharge passage 18.

An oil separator 20 is attached to the side plate 16 with a gasket 21 interposed therebetween and communicates with the discharge chamber 13*a* via the discharge passage 18. Sludge valves 23 are disposed in the oil separator 20 and normally held in contact with the side plate 16 to close the sludge ports 19 by springs 24 and a valve holder 25 fastened by screws 26 to the side plate 16. When the pressure in the working chamber R exceeds the pressure in the oil separtor 20 by a pressure setting given by the springs 24, the sludge valve 23 opens to prevent the interior of the working chamber R from being subjected to an unduly high pressure buildup. The valve holder 25 has an oil supply passageway 27 opening through an oil supply pipe 28 toward a lower surface of the oil separator 20. Lublicating oil collected in a lower portion of the oil separator 20 is pushed upwardly into the oil feed passageway 27 under a pressure difference, from which the lubricating oil is supplied to the rotor end surface 3*a*. Designated at 29 is an oil filter and 30 an oil check valve.

A discharge pipe 31 is attached by a bolt 33 to the oil separator 30 with an O-ring 32 interposed therebetween. The pipe 31 is closed at one end by a blind plug 34. A discharge charging valve 49 is attached to the pipe 31. A refrigerant discharged from the discharge chamber 13*a* into the oil separator 20 is discharged through the discharge pipe 31 after lubricating oil has been separated from the refrigerant in the oil separator 20.

A side plate 35 is attached to an opposite end surface of the housing 8 with an O-ring 36 interposed therebetween, the side plate 35 being made of cast iron (FCR) which is of the same kind as the material of the rotor 3. The side plate 35 accommodates a bearing 37 fitted therein and by which the rotor shaft 5 is rotatably supported. The side plate 35 has an inlet hole 56 through which an inlet chamber (described later) and the working chamber R are connected.

Figure 4:
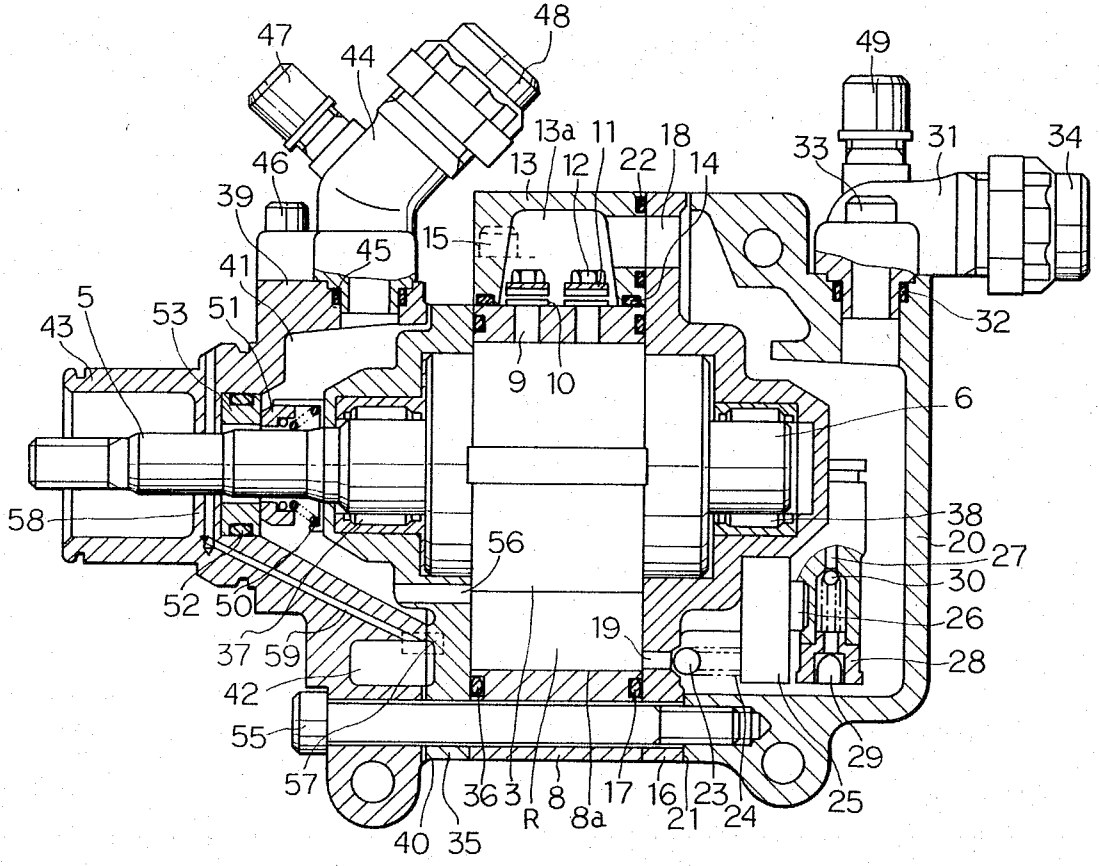
FIG. 4 is a cross-sectional view, partly in elevation, of the vane compressor as assembled of FIG. 2.

A front housing 39 is attached to the side plate 35 with a gasket 40 interposed therebetween, and has an inlet chamber 41 and an oil reservoir 42 (FIG. 4). The gasket 40 is attached accurately to the side plate 35 by positioning pins 57. The front housing 39 has on its outer surface a boss 43 to which an electromagnetic clutch (not shown) is attached. An inlet pipe 44 is attached by a bolt 46 to the front housing 39 with an O-ring 46 interposed therebetween. An inlet charging valve 47 is attached to an intermediate portion of the inlet pipe 44. The inlet pipe 44 is closed at one end by a blind plug 48.

A shaft seal 50 provides a seal between the shaft 5 and the front housing 39, and is composed of a carbon ring 51 rotatable with the shaft 5 and a fixed ring 53 secured through an O-ring 52 to the front housing 39. The hub of the electromagnetic clutch (not shown) is secured to the distal end of the shaft 5 by mean of a key 54 (FIG. 2).

The front housing 39, the gasket 40, the side plate 35, the housing 8, the side plate 16, the gasket 21, and the oil separator 20 are coupled together as one assembly by means of through bolts 55.

Operation of the vane compressor thus constructed is as follows:

When the non-illustrated electromagnetic clutch is actuated to transmit rotative power from an automobile engine to the shaft 5, the shaft 5 that is rotatably supported by the bearings 37, 38 is rotated about its own axis in the housing 8. As the working chamber R is increased in volume as the shaft 5 rotates, the refrigerant introduced from an evaporator in a refrigerating cycle into the suction chamber 41 is drawn into the working chamber R via the inlet hole 56. The introduced refrigerant is progressively compressed as the volume of the working chamber R is reduced, and is discharged through the discharge hole 9 into the discharge chamber 13*a*. Then, lubricating oil is separated from the refrigerant in the oil separator 20, and thereafter the refrigerant is discharged via the discharge pipe 31 into a condenser in the refrigerating cycle.

When the shaft 5 is rotated while the refrigerant is pooled as liquefied in the working chamber R as when the vane compressor is to be started, the pressure in the working chamber R becomes abnormally high. With the vane compressor according to the embodiment of the invention, the sludge valves 23 open the ports 19 in the event of an excessive pressure buildup in the working chamber R, to allow the liquid refrigerant to escape via the ports 19 into the oil separator 20. Therefore, an unduly high pressure buildup in the working chamber R is immediately eliminated and hence the vanes 1 are prevented from suffering from damage which would otherwise be caused by such an undesirable pressure buildup.

The pressure in the working chamber R still increases if the liquid refrigerant is not completely removed from the working chamber R. Even when a high pressure is imposed on the vanes 1, however, the vane slots 2 are prevented from being spread since the rotor 3 is retained at the end surface 3*a* by the holder 4 against radially inward and outward displacement. Accordingly, the rotor 3 and the housing inner surface 8*a* are spaced by a constant gap at all times, and the housing inner surface 8*a* will not be scuffed by the rotor 3.

The rotor 3 and the holder 4 are pressed reliably against each other, and the holder 4 and the rotor cover 6 are also held reliably in intimate contact with each other. Therefore, the rotor 3 and the rotor cover 6 are positioned accurately with respect to each other, with the result that the shaft 5 and the rotor 3 are kept in accurate axial alignment with the rotor cover 6 and hence are rotatably supported properly by the bearings 37, 38.

Lubricating oil pooled in the lower portion of the oil separator 20 is fed through the inlet passageway 27 to the end surface of the rotor cover 6, from which the lubricating oil is led under a pressure difference to the bearing 37 via the outer peripheral surface of the rotor 3. The lubricatingil can therefore be supplied sufficiently to the bearings 37, 38, the gap between the rotor 3 and the housing 8, and the shaft seal 50.

The shaft seal 50 normally provides a sufficient seal during operation. If the lubricating oil leaks through the shaft seal 50, the oil leakage will be stopped by an oil stop 58 and guided into the oil reservoir 42 via a drain passage 59 defined in the front housing 39. In the event of any oil leakage, therefore, leaked oil will not be scattered out of the compressor and hence will not smear surroundings of the compressor.

While in the foregoing embodiment each vane 1 extends through the vane slots 2 and has its opposite ends 1*c* contacting the housing inner surface 8*a*, the vane 1 may be divided into two halves each having a distal end held in slidable contact with the housing inner surface 8*a*.

Figure 5:
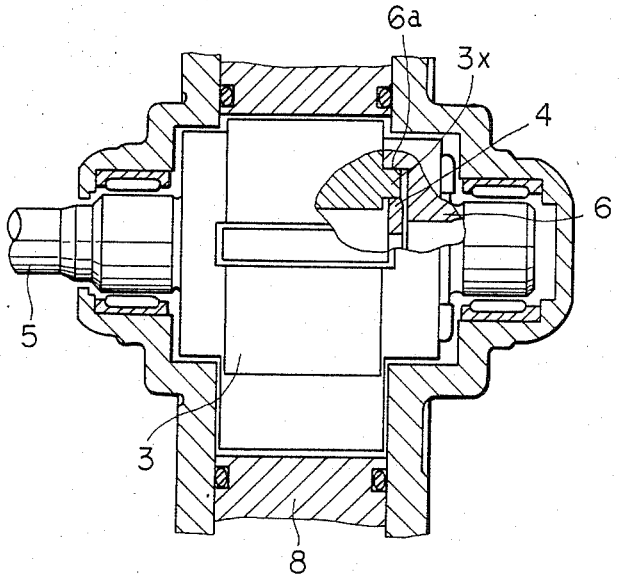
FIG. 5 is a view similar to FIG. 3, showing a vane compressor according to another embodiment of the present invention.

The holder 4 may be of a disc shape as shown in FIG. 5. The holder 4 of FIG. 5 is held only at its outer peripheral surface in abutment against the inner peripheral surface of the locking ridge 3*x*, but is not fitted in the rotor cover 6. With this alternative arrangement, the rotor 3 and the rotor cover 6 are positioned relatively to each other by bringing the outer peripheral surface of the locking ridge 3*x* into intimate contact with the outer edge of the locking groove 6*a*.

Although certain preferred embodiments have been shown and described, it should be understood that many changes and modifications may be made therein without departing from the scope of the appended claims.

What is claimed is:

1. A vane compressor comprising:

(a) a rotatable drive shaft;

(b) a cylindrical rotor rotatable with said rotatable driven shaft and having vane slots defined in the rotor and extending from one end surface thereof fully across the rotor;

(c) vanes slidably disposed in said vane slots;

(d) a rotor cover disposed in covering relation to said one end surface of said rotor;

(e) a housing accommodating said rotor therein, said housing, an outer peripheral surface of said rotor, and said vanes jointly defining a working chamber;

(f) said one end surface of said rotor having a ring-shaped locking ridge, said rotor cover having on an inner surface thereof a locking groove in which an outer peripheral surface of said locking ridge engages; and (g) a holder held by said rotor cover against an inner peripheral surface of said locking ridge.

2. A vane compressor according to claim 1, wherein said holder comprises a stepped cylinder including a larger-diameter portion having an outer peripheral surface held against the inner peripheral surface of said locking ridge and a smaller-diameter portion having an outer peripheral surface fitted in said rotor cover.

3. A vane compressor according to claim 1, wherein said holder comprises a disc having an outer peripheral surface held against the inner peripheral surface of said locking ridge.

* * * * *